US009656124B2

(12) United States Patent
Jaworski et al.

(10) Patent No.: US 9,656,124 B2
(45) Date of Patent: May 23, 2017

(54) SYSTEM OF IMPEDING AND DISCOURAGING THE USE OF EXERCISE EQUIPMENT BY UNAUTHORIZED USERS

(71) Applicants: Tomasz Wojciech Jaworski, Tainan (TW); Brent Thomas Brown, Tainan (TW)

(72) Inventors: Tomasz Wojciech Jaworski, Tainan (TW); Brent Thomas Brown, Tainan (TW)

( * ) Notice: Subject to any disclaimer, the term of this patent is extended or adjusted under 35 U.S.C. 154(b) by 0 days.

(21) Appl. No.: 14/662,226

(22) Filed: Mar. 18, 2015

(65) Prior Publication Data

US 2016/0271453 A1 Sep. 22, 2016

(51) Int. Cl.
*A63B 24/00* (2006.01)
*G08B 5/38* (2006.01)

(52) U.S. Cl.
CPC ..... *A63B 24/0087* (2013.01); *G08B 5/38* (2013.01); *A63B 2220/30* (2013.01); *A63B 2225/70* (2013.01); *A63B 2225/72* (2013.01)

(58) Field of Classification Search
CPC ..... A63B 24/0087; A63B 2225/72
See application file for complete search history.

(56) References Cited

U.S. PATENT DOCUMENTS 2,788,211 A * 4/1957 Ivanoff ..... A63B 21/015 415/124
3,635,471 A * 1/1972 Caron ..... A63B 5/11 482/29
3,817,519 A * 6/1974 Leonhart ..... A63B 67/04 273/126 A
4,635,933 A * 1/1987 Schnell ..... A63B 21/0058 482/137
5,207,621 A * 5/1993 Koch ..... A63B 24/0062 482/112
6,656,091 B1 * 12/2003 Abelbeck ..... A63B 24/0006 482/1
2004/0192508 A1 * 9/2004 Lanoue ..... A63B 21/06 482/51
2010/0137104 A1 * 6/2010 Laghi ..... A63B 22/0235 482/4
2012/0004080 A1 * 1/2012 Webb ..... A63B 21/00065 482/97
2014/0194248 A1 * 7/2014 Kolman ..... A63B 71/0622 482/4

* cited by examiner

*Primary Examiner* — Sundhara Ganesan

(57) ABSTRACT

Exercise equipment having the control system capable to switch the equipment in its existing highest resistance mode in order to impede and thus discourage the usage of this equipment by an unauthorized user. Exercise equipment capable to detect unauthorized use and activating an alarm in order to discourage the usage of this equipment by an unauthorized user.

18 Claims, 1 Drawing Sheet

SYSTEM OF IMPEDING AND DISCOURAGING THE USE OF EXERCISE EQUIPMENT BY UNAUTHORIZED USERS

BACKGROUND

Field of Invention

The present invention relates to the control system capable of activating various features designed to impede and discourage the usage of existing commercial exercise equipment by an unauthorized user.

Description of the Prior Art

FEDERALLY SPONSORED RESEARCH

None

SEQUENCE LISTING

None

At the present time specialized exercise equipment uses special devices in order to prevent an unauthorized user to be able to exercise on it. The present invention uses the existing high resistance mode of existing commercial exercise equipment instead of the additional special braking or blocking devices thus containing fewer parts.

The present invention, instead of braking or blocking the moving parts of the exercise equipment as described in U.S. Pat. No. 7,226,399 to Jean-Paul Lanoue, is actually switching the existing commercial exercise equipment to its proprietary high resistance mode impeding its usage and thus discouraging unauthorized users from using it. Additionally it is capable of detecting unauthorized use and activating an alarm and activating other features designed to discourage the use of this equipment by an unauthorized user.

SUMMARY OF INVENTION

The present invention relates to the control system capable of switching the existing resistance mechanism to its highest resistance mode in order to impede and thus discourage the usage of the equipment by an unauthorized user. Additionally it relates to a control system capable of detecting unauthorized use and activating an alarm and other features designed to discourage the use of the equipment by an unauthorized user.

OBJECTIVES AND ADVANTAGES

The present invention presents various control system solutions to discourage the use of exercise equipment by the unauthorized user that are easier and less expensive to add to the existing commercial exercise equipment than the braking or blocking devices. The present invention instead of using the devices mentioned above utilizes the existing feature of the resistance level selection and switches it to the highest resistance mode. Alternatively it is capable of detecting unauthorized use and activating an alarm and other features designed to discourage the usage of this equipment by an unauthorized user.

DESCRIPTION OF THE EMBODIMENTS

Herein, there follows the description of the present invention in its embodiment.

Figure 1:
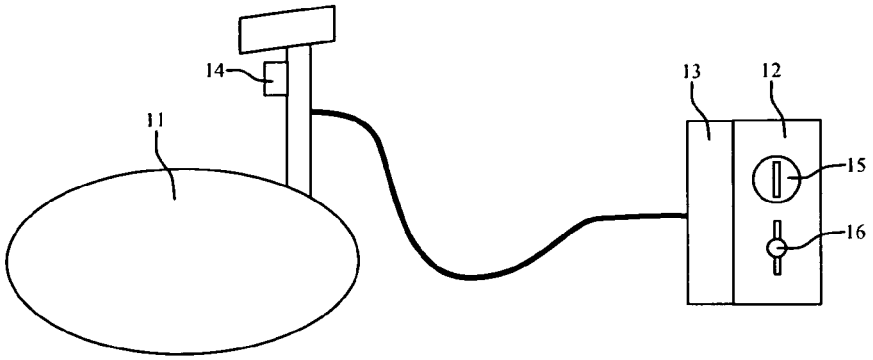
FIG. 1 shows the exercise equipment with the mechanical control system solution.

FIG. 1 shows an exercise equipment 11 with the mechanical system solution containing a commercial authorization device 12, and a mechanical control system 13 capable to switch an existing exercise equipment selector 14 to its highest resistance mode and keep the selector in this mode when the usage of the equipment 11 is not authorized, thus impeding the usage of this exercise equipment 11. This existing selector 14 can be switched by the user to the lower resistance modes only, when the use of the exercise equipment is authorized by the authorizing device 12 by inserting a coin or a set of coins into a slot 15 and turning a knob 16.

Figure 2:
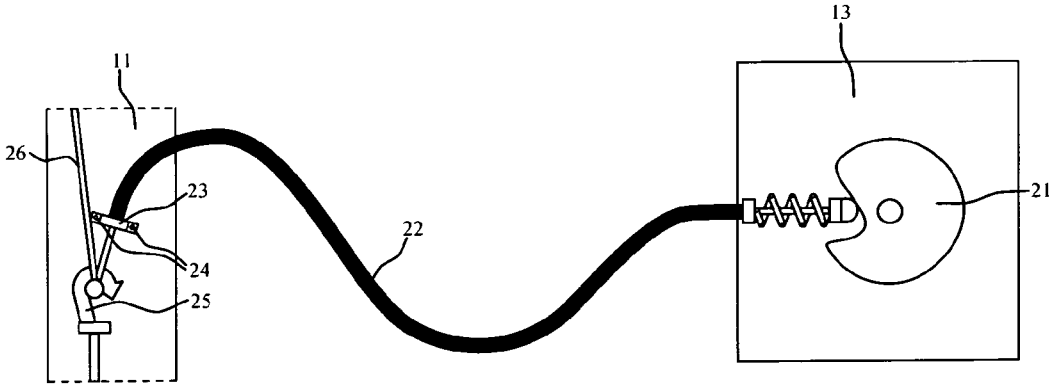
FIG. 2 shows the detail solution of the mechanical control system.

FIG. 2 shows the detail solution of the mechanical control system containing a mechanical control system 13 (FIGS. 1 & 2) with a cam 21 capable to push a spring loaded rod 22 capable to switch an existing exercise equipment selector 14 (FIG. 1) to its highest resistance mode and keep it in this mode when the usage of the equipment is not authorized. Unlocking an authorization device 12 (FIG. 1) by inserting a coin or set of coins into a coin slot 15 (FIG. 1) and turning an authorization device knob 16 (FIG. 1) connected to the cam 21 releases the spring loaded rod 22 tension, pulling a hook 25 connected with a rod 26 both being the part of the exercise equipment and allowing to set the equipment in any of all existing resistance modes. Additionally the spring loaded rod 22 jacket is attached to the exercise equipment frame with a fixture 23 and screws 24 for the proper operation of the spring loaded rod 22.

Herein, there follows the description of the present invention in its second embodiment with additional possible options.

Figure 3:
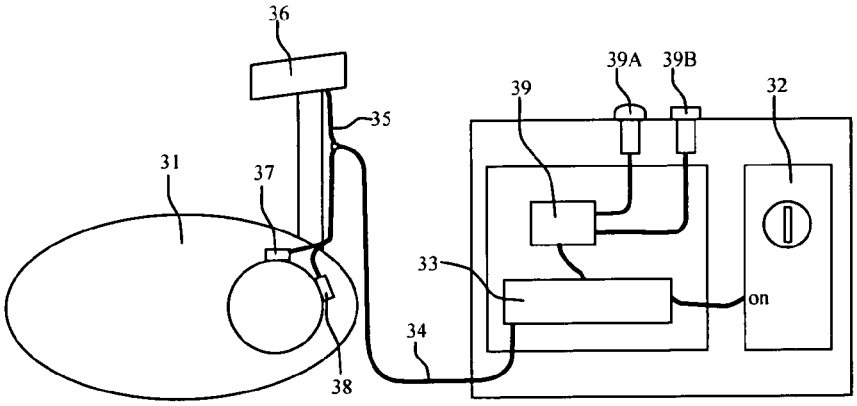
FIG. 3 shows the detail solution of the electrical control system.

FIG. 3 shows an exercise equipment 31 with the electrical system solution containing a commercial electrical authorization device 32 in the form of a coin or token acceptor and an electronic control circuit 33 capable to switch the exercise equipment 31 to its highest resistance mode and keep it in this mode when the usage of the equipment 31 is not authorized, thus impeding the usage of this exercise equipment 31. An electronic control circuit 33 through a cable 34 tapes into an appropriate cable 35 between an exercise equipment console 36 and a resistance mechanism 37 and a speed sensor 38. This embodiment contains also an audio alarm 39A and a flashing light alarm 39B. An alarm generating circuit 39 connected to the electronic control circuit 33 and via the cable 34 and the cable 35 to the speed sensor 38 is capable to switch on either the audio alarm 39A or the flashing light alarm 39B or both, when the use of the exercise equipment is detected by the speed sensor 38 while not authorized by the electrical authorization device 32.

Conclusion, Ramification and Scope

The invention relates to the control system capable to switch the exercise equipment to its high resistance mode in order to discourage the unauthorized user. The particular embodiment has been illustrated and described in example only and is not intended to be limiting. It will be apparent to those skilled in art that various changes and modifications can be made without departing from the scope of the present invention. It is therefore to encompass within the appended claims all such changes and modifications that fall within the scope of the present invention.

What is claimed is:

1. A control system comprising an authorization device and a control device configured to hook into, take over control of and set the resistance mechanism internal to standalone exercise equipment selected from a group comprising, exercise bikes, cross trainers, steppers, rowers, in its high resistance mode in order to impede use of said equipment by an unauthorized user.

2. The control system of claim 1 where said control system's control device is a mechanical device where said equipment comprises an internal mechanical resistance mechanism.

3. The control system of claim 1 where said control system's control device is an electronic device where said equipment comprises an internal electronic/electrical resistance mechanism.

4. The control system of claim 1 where said control system's control device is an electromechanical device where said equipment comprises an internal mechanical resistance mechanism.

5. The control system of claim 1 where said control system's control device is further configured to disconnect said equipment's internal connection between the speed sensors and the console of said equipment to discourage use of said equipment by an unauthorized user.

6. The control system of claim 1 where said control system's control device is further configured to disconnect said equipment's internal connection providing power to the console of said equipment to discourage use of said equipment by an unauthorized user.

7. The control system of claim 1 where said control system's control device is further configured to switch lights, external to said equipment, off in said equipments' compartment in order to discourage use of said equipment by an unauthorized user.

8. The control system of claim 1 where said control system's control device is further configured to switch an air condition system, external to said equipment, off in said equipments' compartment in order to discourage use of said equipment by an unauthorized user.

9. The control system of claim 1 where said control system's control device is further configured to use a sensor, selected from a group comprising, a speed sensor, a motion sensor, a presence sensor, to detect any use of said equipment by an unauthorized user and to activate an alarm in order to discourage use of said equipment by said unauthorized user.

10. The control system of claim 9 where said control system's control device is further configured to disconnect said equipment's internal connection between the speed sensors and the console of said equipment to discourage use of said equipment by an unauthorized user.

11. The control system of claim 9 where said control system's control device is further configured to disconnect said equipment's internal connection providing power to the console of said equipment to discourage use of said equipment by an unauthorized user.

12. The control system of claim 9 where said control system's control device is further configured to switch lights, external to said equipment, off in said equipments' compartment in order to discourage use of said equipment by an unauthorized user.

13. The control system of claim 9 where said control system's control device is further configured to switch an air condition system, external to said equipment, off in said equipments' compartment in order to discourage use of said equipment by an unauthorized user.

14. Exercise equipment comprising an authorization device and a control device configured to use a sensor, selected from a group comprising, a speed sensor, a motion sensor, a presence sensor, to detect any use of said equipment by an unauthorized user and to activate an alarm in order to discourage use of said equipment by said unauthorized user.

15. The exercise equipment of claim 14 further configured to disconnect said equipment's internal connection between the speed sensors and the console of said equipment in order to discourage use of said equipment by an unauthorized user.

16. The exercise equipment of claim 14 further configured to disconnect said equipment's internal connection providing power to the console of said equipment in order to discourage use of said equipment by an unauthorized user.

17. The exercise equipment of claim 14 further configured to switch lights, external to said equipment, off in said equipments' compartment in order to discourage use of said equipment by an unauthorized user.

18. The exercise equipment of claim 14 further configured to switch an air condition system, external to said equipment, off in said equipments' compartment in order to discourage use of said equipment by an unauthorized user.

* * * * *